US006180901B1

(12) United States Patent
Bauer et al.

(10) Patent No.: US 6,180,901 B1
(45) Date of Patent: Jan. 30, 2001

(54) ELECTRICAL ROTARY SWITCH

(75) Inventors: Karl-Heinz Bauer, Bad Neustadt; Ulrich Brueggemann, Bad Mergentheim; Joachim Storath, Salz; Walter Voll, Sanberg, all of (DE)

(73) Assignee: Preh-Werke GmbH & Co. KG, Bad Neustadt/Saale (DE)

( * ) Notice: Under 35 U.S.C. 154(b), the term of this patent shall be extended for 0 days.

(21) Appl. No.: 09/375,567

(22) Filed: Aug. 17, 1999

(30) Foreign Application Priority Data

Aug. 28, 1998 (DE) ..... 198 39 187

(51) Int. Cl.[7] ..... H01H 19/58
(52) U.S. Cl. ..... 200/277; 200/11 R
(58) Field of Search ..... 200/4, 11 R–11 K, 200/564, 565, 570, 571, 277, 336

(56) References Cited

U.S. PATENT DOCUMENTS

| | | | | |
|---|---|---|---|---|
| 3,534,194 | * | 10/1970 | Speller | 200/166 |
| 4,742,187 | * | 5/1988 | Sorenson | 200/11 J |
| 5,204,502 | | 4/1993 | Ferris et al. | 200/4 |
| 5,227,595 | * | 7/1993 | Sorenson et al. | 200/11 J |
| 5,959,269 | * | 9/1999 | Bauer et al. | 200/11 R |

FOREIGN PATENT DOCUMENTS

| | | | |
|---|---|---|---|
| 1 921 801 | 11/1970 | (DE) | H01H/1/00 |
| 25 05 760 C3 | 5/1978 | (DE) | H01H/19/22 |
| 82 11 566 U | 8/1982 | (DE) | H01H/19/20 |
| 197 20 544 C1 | 4/1998 | (DE) | H01H/19/54 |

* cited by examiner

*Primary Examiner*—Michael Friedhofer
(74) *Attorney, Agent, or Firm*—Birch, Stewart, Kolasch & Birch, LLP

(57) ABSTRACT

An electrical rotary switch for several switch positions having a control knob mounted in a housing supported on first, second and third ball bearings that, guided by a cage disk, roll in a housing groove formed by an axial wall and a radial wall against which the ball bearings are loaded under an applied force of a conical bearing surface of the control knob. Axial and radial wall bearing surfaces respectively have first and second contact segments and first, second and third contact bands thereon that extend out of the housing via terminal lugs, the first contact segment and first contact band being shorted by the first ball bearing in predetermined switch positions. In a last switch position, contact occurs between the second contact segment (19) and the second and third contact bands (20, 21) through the second and third ball bearings (6, 7).

8 Claims, 2 Drawing Sheets

ELECTRICAL ROTARY SWITCH

BACKGROUND OF THE INVENTION

This invention relates to an electrical rotary switch for several switch positions having a control knob mounted in a housing supported on one side, or on two sides, by three ball bearings that, guided by a cage disk, roll in a housing groove formed by an axial wall and a radial wall against which the ball bearings are loaded under the pressure of an outer or inner conical bearing surface of the control knob, whereby the axial—and radial-wall bearing surfaces respectively have contact segments and contact bands thereon that extend out of the housing via terminal lugs and are shorted by a first of the ball bearings in predetermined switch positions.

German patent document (DE 197 20 544. 4), for example, which has not previously been published, discloses a rotary switch of this type having circularly-arranged contacts in a base unit.

This rotary switch provides a compact structure with sensitive adjustment, having a sufficiently large adjustment range of the control knob, which is based on the principle that a ball or roller on which an object rolls, rolls at half the speed of the object, and travels only half the distance. In the described embodiment of a rotary switch, a step down is achieved from the actuating movement of the control knob to displacement of ball bearings, and to displacement of a cage guiding the ball bearings, without, for example, requiring toothed gearing. Since ball bearings have only one point of contact to their supports, current flowing through the ball bearings is limited. There arises, therefore, a need, in order to achieve given sensitive adjustments, to also be able to switch-in greater currents, particularly in a last position of a step switch.

Accordingly, it is an object of the invention to provide a rotary switch of the type set forth in the opening paragraph above which has a sensitive adjustment and an increased switching current.

SUMMARY OF THE INVENTION

According to principles of this invention, in a last switch position of a rotary switch of the type set forth in the opening paragraph above, contact occurs between a second contact segment and second and third contact bands through second and third ball bearings. In one embodiment contact between a first contact segment and a first contact band is also maintained by the first ball bearing in the last switch position. In one embodiment the second contact segment has indexing positions corresponding to switch positions of one of the second and third ball bearings, the indexing positions being formed by recesses in the second contact segment into which the ball bearing engages. In another embodiment the first contact segment has recesses corresponding to the switch positions of the first ball bearing. In one embodiment a conical bearing surface of the control knob has recesses, corresponding to indexing positions in which at least one of the first, second and third ball bearings engages. It is a feature of the rotary switch of this invention that, in the last switching position, contacting occurs between the second contact segment and the second and third contact bands through the second and third ball bearings positioned on one or on two sides of the second contact segment. A high current load of the rotary switch is achieved in this manner.

BRIEF DESCRIPTION OF THE DRAWING

The invention is described and explained in more detail below using an embodiment shown in the drawings. The described and drawn features, can be used in other embodiments of the invention, individually or in preferred combinations. The foregoing and other objects, features and advantages of the invention will be apparent from the following more particular description of a preferred embodiment of the invention, as illustrated in the accompanying drawings in which reference characters refer to the same parts throughout the different views. The drawings are not necessarily to scale, emphasis instead being placed upon illustrating principles of the invention in a clear manner.

DESCRIPTION OF THE PREFERRED EMBODIMENT

Figure 1:
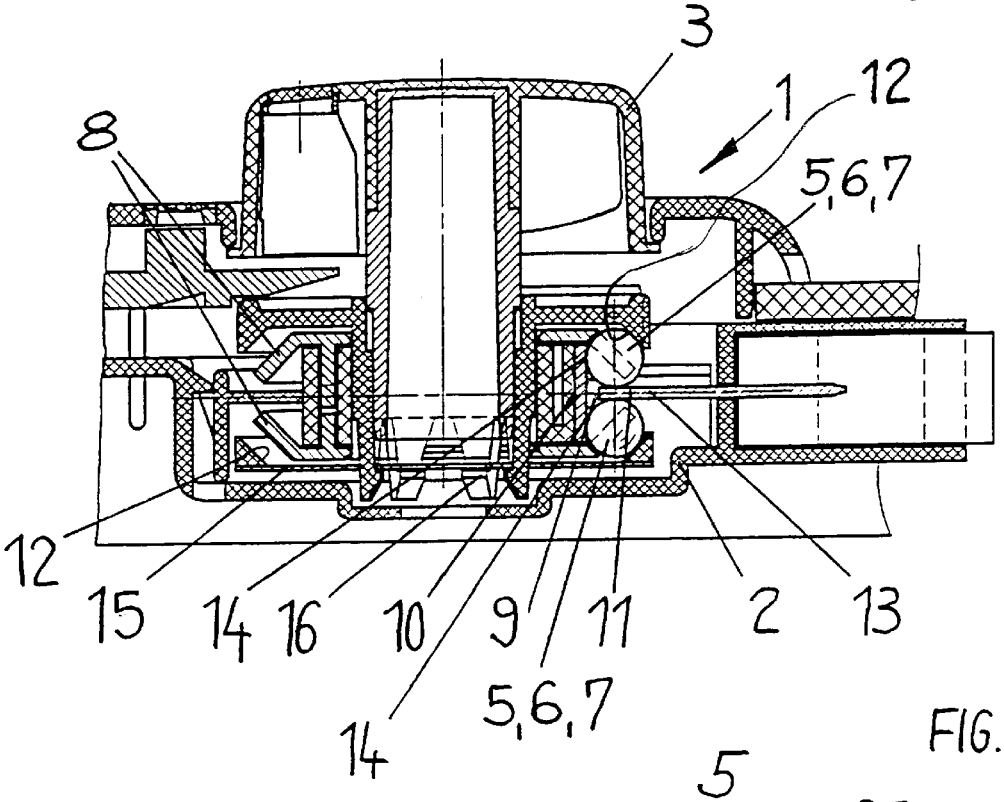
FIG. 1 is a cross section of an exemplary embodiment of a rotary switch according to the invention.

FIG. 1 shows a cross section of an electrical rotary switch 1 having a control knob 3 mounted in a housing 2, a maximum actuation displacement angle of which is larger than a maximum contact position angle 4, as is explained in further detail below with reference to FIG. 2. The control knob 3 is supported on three (first, second and third) ball bearings 5, 6, 7, that, guided by a cage disk 8, roll in a housing groove 9 formed by a radial wall 10 and an axial wall 11, against which the first, second and third ball bearings 5, 6, 7 are loaded under an applied force of an inner conical bearing surface 12 of the control knob 3.

In an alternative embodiment an outer conical bearing surface is provided instead of the inner conical bearing surface 12. These two embodiments for supporting the first, second and third ball bearings 5, 6, 7, and of the control knob 3 make possible low-friction adjustment of the control knob 3.

The axial and radial wall bearing surfaces 11, 10 have contact segments 13 and contact bands 14 that are shorted by the first, second and third ball bearings 5, 6, 7, in this instance by the first ball bearing, in predetermined switch positions. The first, second and third ball bearings 5, 6, 7 are made of a highly conductive material and can be coated with a precious metal. Thus contact bridges, brushes, etc. used in the prior art are omitted, providing exceptional cost savings.

Figure 2:
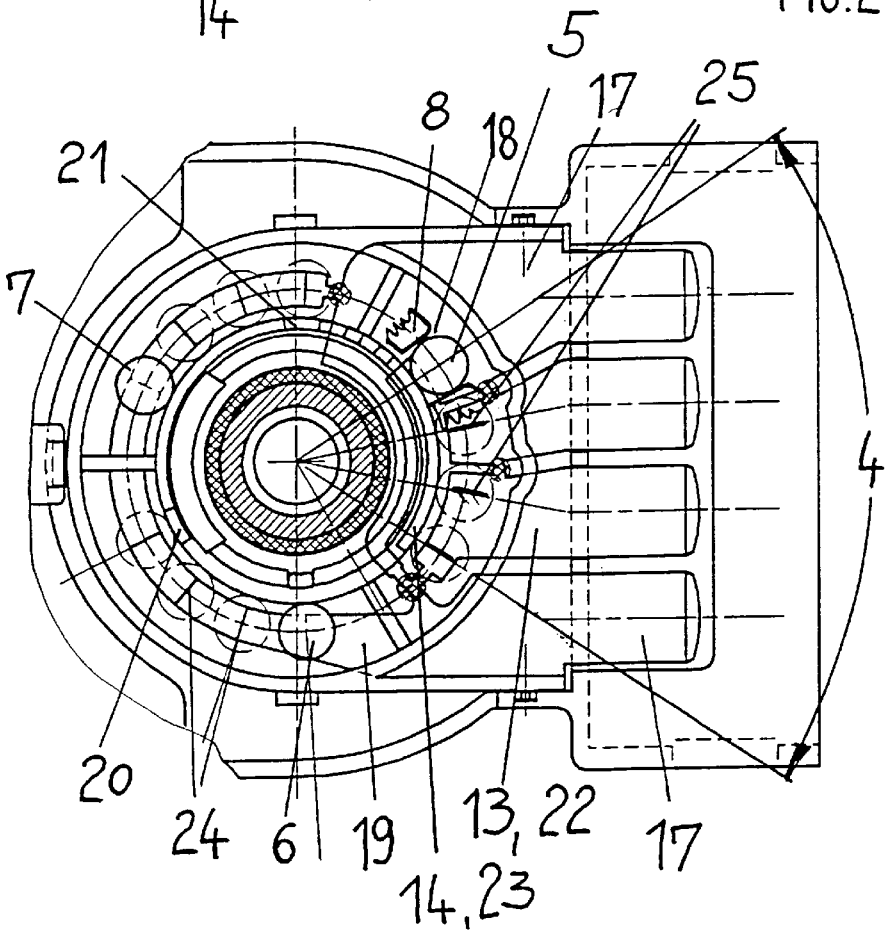
FIG. 2 is a plan view of the opened rotary switch of FIG. 1, and FIGS. 3 and 4 are straightened views of a section through the rotary switch according to FIG. 2.

In the embodiment shown in FIGS. 1 and 2, two-sided contacting occurs via two sets of first, second and third ball bearings 5, 6, 7, contact bands 14, and an additional inner conical bearing surface 12 positioned on opposite sides of the contact segments 13, whereby this additional inner conical bearing surface 12 is located on a sealing ring 15 mounted on the control knob 3, that, when installed, is supported under tension on a collar 16 of the control knob 3.

The control knob 3 has a stop projection (not shown), so that its actuation displacement angle is limited by housing stops (not shown). This stop projection is contacted during actuation by at least one of two stop projections (not shown) of the cage disk 8, that are positioned at an angle corresponding to approximately half the maximum displacement adjustment angle, or the maximum contact position angle 4, as shown in FIG. 2.

It is provided that the contact segments 13 and the contact bands 14 have leads out of the housing 2 via terminal lugs 17.

FIG. 2 shows a view of an open rotary switch 1 in which the first, second and third ball bearings 5, 6, 7 are shown inside guide recesses 18 of the cage disk 8, and also shows the maximum contact position angle 4, that corresponds to approximately half the maximum actuation angle, under which the stop projections of the cage disk 8 are arranged. The maximum contact position angle 4 is divided into three switch positions, shown by dashed circles that correspond to the switch positions of the first ball bearing 5.

According to the invention, in a last switch position of the control knob 3, second and third ball bearings 6, 7 contact an additional contact segment 19, positioned on one side or two sides, and at least two additional contact bands 20, 21, whereby it is advantageously provided that, in the last switch position, contact between the first contact segment 13 and the first contact band 14, here designated as contact segment 22 and contact band 23, is maintained by the first ball bearing 5.

Figure 3:
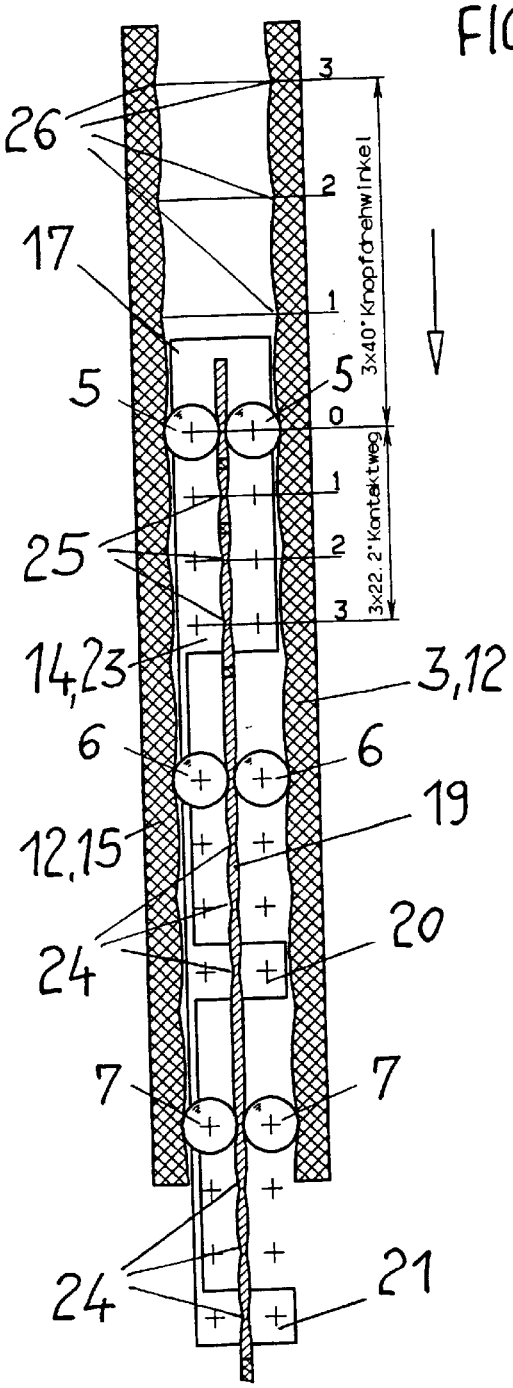
Figure 4:
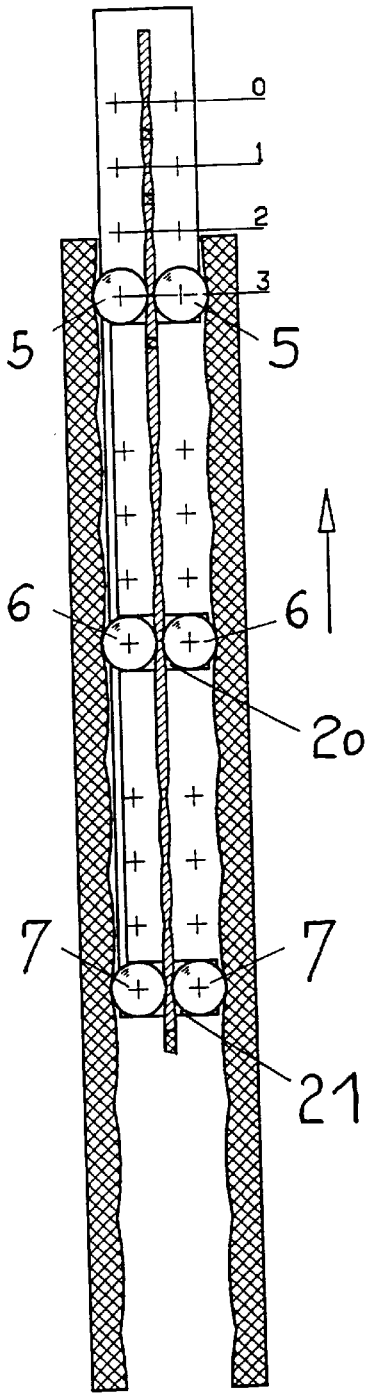

It is also advantageous if the second contact segment 19 of the last switch position has indexing elements corresponding to switch positions of one of the second and third ball bearings 6, 7, formed by recesses 24 of the second contact segment 19 in which the ball bearings 6, 7 engage as shown in FIGS. 3 and 4, a straightened sectional cut through the housing groove 9, whereby the first contact segment 13, as well, can have recesses 25 corresponding to the switch positions of the first ball bearing 5, and likewise, the inner conical bearing surfaces 12 of the control knob 3 and, if applicable, the sealing ring 15, can have indexing recesses 26 in which the ball bearings 5, 6, 7 engage.

FIG. 3 shows the first, second and third ball bearings 5, 6, 7 in the positions that they assume in the zero (0) switch position, in which the contact bands 20, 21 are not shorted with the contact segment 19, and FIG. 4 shows them in the positions that they assume at the end (3) switch position in which the contact bands 20, 21 are then shorted with the contact segment 19 via the ball bearings 6, 7.

The terminal lugs 17 leading out of the housing 2 make possible the electrical connection of the first contact band 14 to the positive pole of a voltage source. The loads can be connected via the terminal lugs 17 of the first contact segment 13, whereby the last switch position, in particular, is increased to a high current load, since in addition to the contact provided via the first ball bearing 5 between the first contact segment 13 and first contact band 14, two additional contacts between the second contact segment 19 and the second and third contact bands 20, 21 are provided.

It is obvious that the second and third contact bands 20, 21 are also connected to the positive pole of the voltage source, i.e. they are structured as a single piece with the first contact band 14 or its terminal lug 17.

The invention is not limited to the illustrated embodiments; various numbers of ball bearings, contact segments and contact bands can be provided without exceeding the scope of the invention. Further, the contact segments can be interconnected or formed as one piece, as can the contact bands.

The invention claimed is:

1. Electrical rotary switch for several switch positions having a control knob positioned in a housing supported on first, second and third ball bearings that, guided by a cage disk, roll in a housing groove formed by an axial housing wall and a radial housing wall against which the ball bearings are loaded under an applied force of a conical bearing surface of the control knob, whereby bearing surfaces of the axial and radial housing walls respectively have first and second contact segments and first, second and third contact bands thereon that extend out of the housing via terminal lugs with the first contact segment being shorted to the first contact band through the first ball bearing in a first switch position, wherein, in a second switch position, the second contact segment is shorted to the second and third contact bands by the second and third ball bearings.

2. Electrical rotary switch as in claim 1, wherein, in the second switch position, contact between the first contact segment and the first contact band is maintained by the first ball bearing.

3. Electrical rotary switch as in claim 1, wherein the second contact segment has an indexing position corresponding to at least one of the first and second switch positions of at least one of the second and third ball bearings that is formed by a recess in the second contact segment into which said at least one of the second and third ball bearings engages.

4. Electrical rotary switch as in claim 3, wherein the first contact segment has a recess corresponding to at least one of the first and second switch positions of the first ball bearing for receiving the first ball bearing.

5. Electrical rotary switch as in claim 3, wherein the conical bearing surface of the control knob has recesses, corresponding to indexing positions into which at least one of the first, second and third ball bearings engages.

6. Electrical rotary switch as in claim 1, wherein in the second switch position the second contact segment is shorted to the third contact band through the third ball bearing.

7. Electrical rotary switch for several switch positions having a control knob positioned in a housing supported on first, second and third ball bearings that, guided by a cage disk, roll in a housing groove formed by an axial housing wall and a radial housing wall against which the ball bearings are loaded under an applied force of a conical bearing surface of the control knob, whereby bearing surfaces of the axial and radial housing walls respectively have first and second contact segments and first and second contact bands thereon that extend out of the housing via terminal lugs with the first contact segment being shorted to the first contact band through the first ball bearing in a first switch position, and, in a second switch position, the second contact segment is shorted to the second contact band by one of the second and third ball bearings; wherein the second contact segment has an indexing position corresponding to at least one of the first and second switch positions of at least one of the second and third ball bearings that is formed by a recess in the second contact segment into which said at least one of the second and third ball bearings engages; and wherein the first contact segment has an indexing-position recess corresponding to at least one of the first and second switch positions of the first ball bearing for receiving the first ball bearing.

8. Electrical rotary switch for several switch positions having a control knob positioned in a housing supported on first, second and third ball bearings that, guided by a cage disk, roll in a housing groove formed by an axial housing wall and a radial housing wall against which the ball bearings are loaded under an applied force of a conical bearing surface of the control knob, whereby bearing surfaces of the axial and radial housing walls respectively have first and second contact segments and first and second contact bands thereon that extend out of the housing via terminal lugs with the first contact segment being shorted to the first contact band through the first ball bearing in a first switch position, and, in a second switch position, the second contact segment is shorted to the second contact band by one of the second and third ball bearings; wherein the second contact segment has an indexing position corresponding to at least one of the first and second switch positions of at least one of the second and third ball bearings that is formed by a recess in the second contact segment into which said at least one of the second and third ball bearings engages; and wherein the conical bearing surface of the control knob has recesses, corresponding to indexing positions into which at least one of the first, second and third ball bearings engages.

* * * * *